US007744356B2

(12) United States Patent
Ohmi

(10) Patent No.: US 7,744,356 B2
(45) Date of Patent: Jun. 29, 2010

(54) SCREW VACUUM PUMP WITH MALE AND FEMALE SCREW ROTORS HAVING UNEQUAL LEADS

(75) Inventor: Tadahiro Ohmi, Miyagi (JP)

(73) Assignee: Foundation For Advancement of International Science, Tsukuba (JP)

( * ) Notice: Subject to any disclaimer, the term of this patent is extended or adjusted under 35 U.S.C. 154(b) by 0 days.

(21) Appl. No.: 10/547,695

(22) PCT Filed: Mar. 2, 2004

(86) PCT No.: PCT/JP2004/002530

§ 371 (c)(1),
(2), (4) Date: Oct. 19, 2005

(87) PCT Pub. No.: WO2004/079198

PCT Pub. Date: Sep. 16, 2004

(65) Prior Publication Data

US 2006/0216189 A1 Sep. 28, 2006

(30) Foreign Application Priority Data

Mar. 3, 2003 (JP) ..... 2003-055351

(51) Int. Cl.
*F03C 2/00* (2006.01)
*F03C 4/00* (2006.01)
*F04C 2/00* (2006.01)

(52) U.S. Cl. ..... 418/9; 418/189; 418/201.1; 418/201.3

(58) Field of Classification Search ..... 418/9, 418/201.1, 201.3, 194
See application file for complete search history.

(56) References Cited

U.S. PATENT DOCUMENTS

| | | | | |
|---|---|---|---|---|
| 2,358,815 | A * | 9/1944 | Lysholm | 418/9 |
| 2,543,894 | A * | 3/1951 | Colombo | 425/204 |
| 3,424,373 | A * | 1/1969 | Gardner | 418/201.1 |
| 3,807,911 | A * | 4/1974 | Caffrey | 418/201.1 |
| 5,667,370 | A * | 9/1997 | Im | 418/201.1 |
| 6,359,411 | B1 * | 3/2002 | Kosters et al. | 418/9 |
| 7,150,611 | B2 * | 12/2006 | Perna | 418/201.1 |

FOREIGN PATENT DOCUMENTS

| | | |
|---|---|---|
| JP | 3-111690 | 5/1991 |
| JP | 8-121361 | 5/1996 |
| JP | 9-004580 A | 1/1997 |
| JP | 11-270482 | 10/1999 |
| JP | 11-270485 | 10/1999 |
| JP | 2001-55992 A | 2/2001 |
| JP | 2002-031071 A | 1/2002 |
| JP | 2002-061589 A | 2/2002 |

* cited by examiner

*Primary Examiner*—Theresa Trieu
(74) *Attorney, Agent, or Firm*—Foley & Lardner LLP

(57) ABSTRACT

In a screw vacuum pump 30, equal lead screws each in the range of 1 to 4 leads are added on the discharge side of male and female screw rotors (4) and (5) having a continuously changing screw gear helix angle, at a final lead angle of the male and female unequal lead screw rotors on the discharge side that continuously change in helix angle following the advance of the screw gear helix.

8 Claims, 3 Drawing Sheets

SCREW VACUUM PUMP WITH MALE AND FEMALE SCREW ROTORS HAVING UNEQUAL LEADS

TECHNICAL FIELD

This invention relates to a screw vacuum pump and, in particular, relates to a screw vacuum pump that is optimal for a region from atmospheric pressure to 0.1 Pa.

BACKGROUND ART

In a semiconductor device manufacturing system, since a serious problem arises in a semiconductor device manufacturing process if oil back diffusion occurs from a pump into a process chamber of the semiconductor device manufacturing system, use has conventionally been made of a so-called dry pump, a mechanical booster pump, a turbomolecular pump, and the like where there is no occurrence of contact between suction gas and oil.

With respect to these dry pump, mechanical booster pump, and screw pump, a problem exists that shaft seals are provided at both ends, i.e. on the suction side and the discharge side, and particularly a seal gas amount of the shaft seal on the suction side and a leakage amount from the seal cause a reduction in pumping speed so that there is no alternative but to use such a pump that has an unnecessarily high pumping speed.

Further, since molecular weights of process gas, carrier gas, gas to be produced, and so on are broad, i.e. from 1 to one hundred and several tens, it is the current situation that the foregoing pumps are properly used depending on their pumping characteristics for those various gases and their inherent pumping regions.

On the other hand, a problem exists that since the pumping speed is lowered depending on the kind of exhaust gas, a pump having a large pumping speed is inefficiently used. Further, with respect to general dry pumps and mechanical booster pumps, there is a problem that product is deposited inside the pump between an inlet port and a discharge port.

Drawbacks of a conventional screw pump will be explained with reference to FIG. 5.

Referring to FIG. 5, in the conventional screw vacuum pump, since a back-diffusion amount from a discharge port and a back-diffusion amount of diluent gas are large, the ultimate pressure becomes about 3 Pa and, as indicated by a curve 2 in FIG. 5, the pumping speed largely decreases on the molecular flow region side. Further, the pumping speed for hydrogen becomes ⅓ to ½ of that for nitrogen and, as indicated by a curve 3 in FIG. 5, since the compression ratio is small, the pumping speed extremely decreases.

Further, since screw engagement of the conventional screw vacuum pump is not located outside gear engagement pitch circles determined by a distance between axes of male and female rotors and the numbers of teeth of the male and female rotors, product generated in the semiconductor device manufacturing process is stuck to screw engagement portions, thereby causing failure.

Therefore, it is an object of this invention to provide a screw vacuum pump that can maintain the stable pumping performance down to about 0.1 Pa regardless of the kind of gas.

DISCLOSURE OF THE INVENTION

For accomplishing the foregoing object, according to one aspect of the present invention there is provided a screw vacuum pump which comprises a male rotor and a female rotor respectively having engagement screw gears, a stator receiving therein both rotors, a gas working chamber formed by the male rotor and the female rotor and the stator, and an inlet port and a discharge port for a gas provided at the stator so as to be capable of communicating with one end portion and the other end portion of the working chamber, respectively. In the aspect of the present invention, the male and female rotors each comprise a main lead screw in which a helix angle of the screw gear continuously changes following the advance of helix, and an auxiliary lead screw in the form of an equal lead screw formed in the range of 1 to 4 leads at a final lead angle of the main lead screw on a discharge side of the male and female rotors.

In the aspect of the present invention, by forming the equal lead portions having the lead angle equal to the discharge-end lead angle on the discharge side, it is possible to prevent back diffusion of the gas and largely improve the compression ratio and, as a result of preventing the back diffusion, it is possible to reduce the consumption power and reduce the heat that is generated on the discharge side.

Further, according to another aspect of the present invention there is provided a screw vacuum pump which comprises a male rotor and a female rotor respectively having engagement screw gears, a stator receiving therein both rotors, a gas working chamber formed by the male rotor and the female rotor and the stator, and an inlet port and a discharge port for a gas provided at the stator so as to be capable of communicating with one end portion and the other end portion of the working chamber, respectively. In the aspect of the present invention, the male and female rotors each comprise a main lead screw in which a helix angle of the screw gear continuously changes following the advance of helix, and an additional lead screw provided on an inlet side of the male and female rotors, the additional lead screw being in the form of an equal lead screw formed in the range of 0.2 to 1 lead at a lead angle of the main lead screw at its end portion on the inlet side.

Further, according to still another of the present invention, there is provided a screw vacuum pump which comprises a male rotor and a female rotor respectively having engagement screw gears, a stator receiving therein both rotors, a gas working chamber formed by the male rotor and the female rotor respectively having engagement screw gears and the stator, and an inlet port and a discharge port for a gas provided at the stator so as to be capable of communicating with one end portion and the other end portion of the working chamber, respectively. In the aspect of the present invention, engagement of the screw gears of the male and female rotors is located outside gear engagement pitch circles determined by a distance between axes of the male and female rotors and the numbers of teeth of the male and female rotors.

Further, according to yet another aspect of the present invention, there is provided a screw vacuum pump which is characterized in that the screw gears of the male and female rotors have mutually different numbers of teeth in any one of the foregoing screw vacuum pumps.

Further according to a further aspect of the present invention, there is provided a screw vacuum pump which is characterized in that the male and female rotors each comprise an unequal lead screw at its middle portion in an axial direction thereof in any one of the foregoing screw vacuum pumps.

Further, in a screw vacuum pump according to the aspect of the present invention, equal lead portions having a lead angle equal to an inlet-side lead angle and equal lead portions having a lead angle equal to a discharge-end lead angle are formed on an inlet side and a discharge side, respectively, of male and female unequal lead screw rotors, and engagement of the male and female screw rotors is formed at a position outside gear engagement pitch circles determined by a distance between axes of the male and female rotors and the numbers of teeth of the male and female rotors. Therefore, it is possible to increase the compression ratio, obtain an effect of raking out product, and maintain the stable pumping speed down to 0.1 Pa.

BEST MODE FOR CARRYING OUT THE INVENTION

Hereinbelow, an embodiment of this invention will be described with reference to FIGS. 1 to 4.

Figure 1:
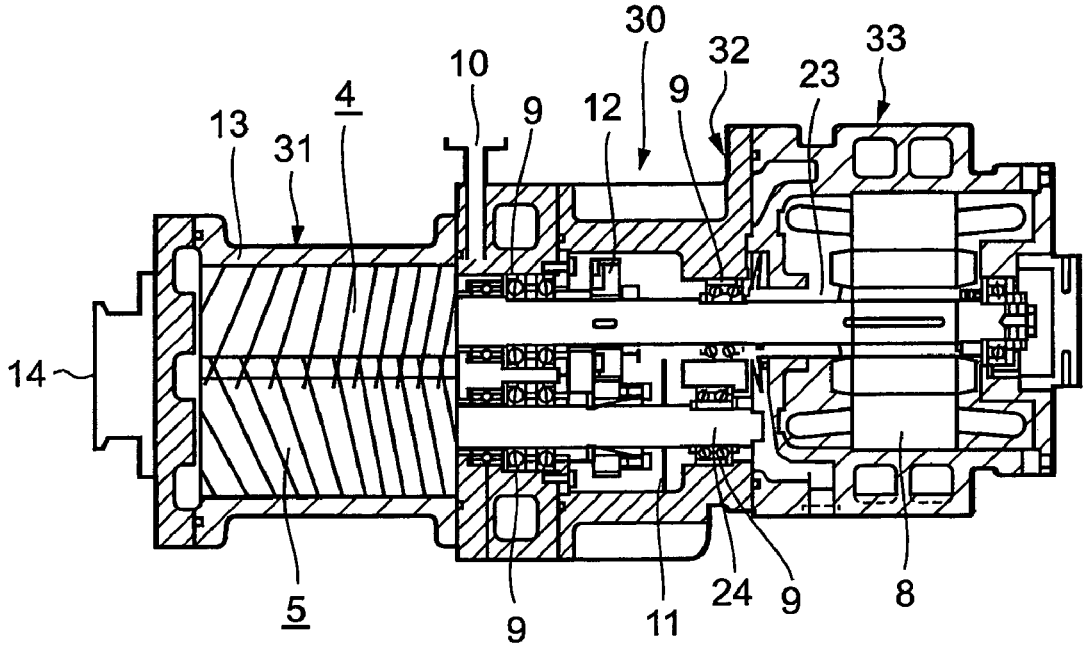
FIG. 1 is a sectional view showing the overall structure of a screw vacuum pump according to an embodiment of this invention.
Figure 2:
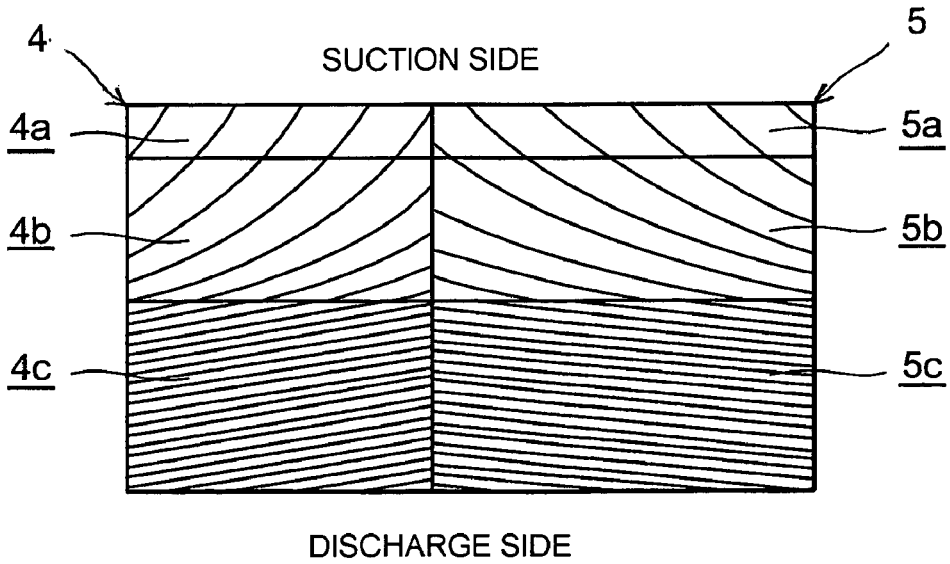
FIG. 2 is an expansion view wherein equal lead screws are added to unequal lead screws in FIG. 1 according to the embodiment of this invention.

FIG. 1 is a sectional view showing the overall structure of a screw vacuum pump according to the embodiment of this invention, wherein male and female screw rotors 4 and 5 are illustrated as having unequal leads. FIG. 2 is an expansion view showing a structure in which equal lead screws are added to unequal lead screws, respectively, of the male and female screw rotors shown in FIG. 1 according to the embodiment of this invention, FIG. 3 is a development view showing tooth rolling curves of the lead screws according to the embodiment of this invention, and FIG. 4 is a diagram showing a relationship between engagement of the male and female screws and engagement circles determined by a distance between the male and female axes and the numbers of teeth of the screws.

This invention will be described in further detail. As shown in FIG. 2, on the discharge side of unequal lead portions (main lead screws) 4*b* and 5*b* of the male and female unequal lead screw rotors 4 and 5, equal lead portions (sub lead screws) 4*c* and 5*c* having a lead angle equal to a discharge-end lead angle of the unequal lead portions 4*b* and 5*b* are formed in the screw vacuum pump.

Figure 3:
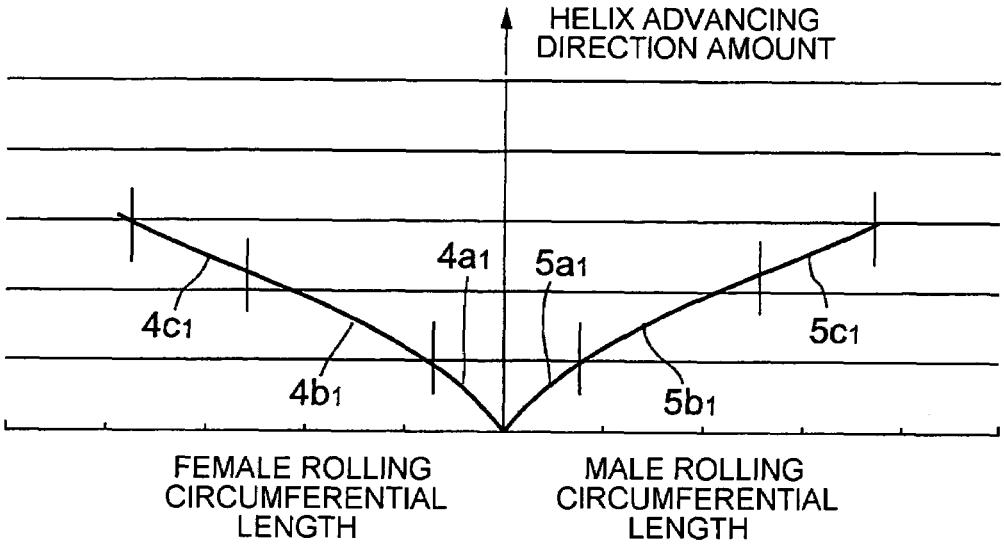
FIG. 3 is a development view on base cylinders according to the embodiment of this invention, wherein tooth helix curves of tooth-shaped external contact portions in the form of parabolas (quadratic curves) are shown on a coordinate axis in which the axis of abscissa represents male and female rolling circumferential lengths of the base cylinders and the axis of ordinate represents a helix advancing amount.
Figure 4:
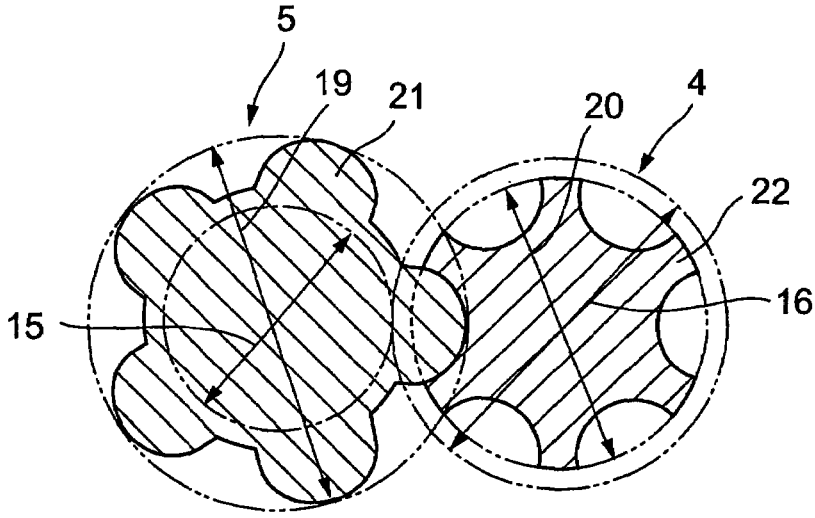
FIG. 4 is a perpendicular-to-axis sectional view of the screws according to the embodiment of this invention.

In this invention, as shown in FIGS. 2 and 3, the equal leads 4*c* and 5*c* each having 1 to 4 leads are added at the discharge end of the unequal lead screws as equal leads having the discharge-end lead angle of the unequal lead screws. In the unequal lead screws, the tooth helix angle of screw gears forming male and female rotors of an unequal lead screw vacuum pump changes according to a rotation angle of the rotors to thereby change the volume of a V-shaped working chamber formed by the rotors and a stator. In the unequal lead screw vacuum pump, a working chamber with a constant volume that merely transfers a sucked gas without compressing it is abolished and the volume between the leads of the engagement female and male lead screw rotors is continuously reduced so that all working chambers serve to compress the gas.

An important point of this invention herein resides in that the compression ratio of the screw vacuum pump is reduced by adding the equal leads 4*c* and 5*c* at the discharge end, thereby suppressing back diffusion from a discharge port 10 shown in FIG. 1. This is because a back-diffused gas enters the working chamber and is again compressed and exhausted, thereby increasing an electric power consumption and, due to an increase in back diffusion, the ultimate pressure and the pumping speed are largely affected. The suppression of the back diffusion leads to electric power saving.

Further, since the unequal lead screws perform compression and exhaust even at their final lead portions, expansion and deformation occur due to compression heat near the discharge port to thereby cause contact between the screws and between the screw and the stator, which is thus not preferable. This invention solves this problem by adding the equal leads 4*c* and 5*c* having a thermally stable structure and a structure that facilitates precise processing.

Further, in this invention, as shown in FIG. 4, it is configured that engagement of the male and female screw rotors 21 and 22 of the screw vacuum pump is located outside gear engagement pitch circles 15 and 16 determined by a distance between the axes of the male and female rotors and the numbers of teeth of the male and female rotors, thereby providing no tooth surfaces where the tooth-surface speeds of the male and female screws are equal to each other, to obtain the state where a faster tooth surface slides on a slower tooth surface, to thereby achieve an operation of raking out sucked reaction product or the like existing between the tooth surfaces and thus achieve an effect of raking out the reaction product to the exterior of the pump.

Now, one example of the screw vacuum pump according to this invention will be described in further detail with reference to FIGS. 1 to 4.

Referring to FIG. 1, a screw vacuum pump 30 has a structure in which a first housing 31, a second housing 32, and a third housing 33 are connected in an axial direction in the order named from the pump side.

The first housing 31 comprises a stator 13 and has one end side provided with an inlet port 14 for sucking a fluid and the other end side communicating with the second housing 32. At a connecting portion, with the first housing 31, of the second housing 32, the discharge port 10 is provided for discharging the fluid. In the stator 13 of the first housing 31, a female screw rotor 4 and a male screw rotor 5 are disposed that mesh with each other and use, as their rotation shafts, a first shaft 23 and a second shaft 24 received in the second housing 32.

In the second housing 32, the first shaft 23 serving as the rotation shaft of the female screw rotor 4 and the second shaft 24 serving as the rotation shaft of the male screw rotor 5 are provided so as to extend in the axial direction from the respective screw rotors 4 and 5 disposed in the first housing 31, and the first shaft 23 extends into the third housing 33. The first shaft 23 and the second shaft 24 are rotatable by the use of bearings 9 disposed at both ends of the respective shafts in the second housing 32. An oil splashing mechanism 11 is disposed around the second shaft 24 in the second housing 32 and engagement timing gears 12 are provided at substantially the same positions in the axial direction of the first shaft 23 and the second shaft 24.

In the third housing 33, an electric motor 8 is disposed which uses one end of the first shaft 23 as its rotation shaft. The first shaft 23 held by the bearings 9 is rotated by the motor 8 disposed in the third housing 33 and this rotation synchronously rotates the first and second shafts 23 and 24 through the timing gears 12. The oil splashing mechanism 11 is attached to the second shaft 24 for supplying oil to the timing gears 12 and the bearings 9.

On the pump side, a high vacuum is achieved by high-speed rotation of the screw rotors comprising the female screw rotor 4 and the male screw rotor 5.

Referring to FIG. 2, the male screw rotor is formed by an equal lead screw 5*a*, the unequal lead screw 5*b*, and the equal lead screw 5*c* from the suction side. Likewise, the female screw rotor is formed by an equal lead screw 4*a*, the unequal lead screw 4*b*, and the equal lead screw 4*c* from the suction side. In this invention, additional lead screws represent the equal lead screws 4*a* and 5*a*. Specifically, in this embodiment, the outer diameter of the male screw rotor is set to 80 mm and the inner diameter of the female screw rotor is set to 100 mm. The equal lead screws 4*a* and 5*a* and the equal lead screws 4*c* and 5*c* on the suction and discharge sides are each set to a length of about 50 mm and may be set in the range of 0.2 to 1 lead and in the range of 1 to 4 leads, respectively. When being outside these ranges, each of equal leads screws 4*a* and 5*a* has a less effect of thermally stable operation. It is preferable that the lead angle of the equal lead screws 4*a* and 5*a* on the suction side be set to 45 degrees where the maximum efficiency is obtained. Further, the unequal lead screws 4*b* and 5*b* at the middle portion are each set to a length of about 120 mm.

FIG. 3 is a development view showing tooth rolling curves in the form of parabolas (quadratic curves) on a coordinate axis in which the axis of abscissa represents male and female rolling circumferential lengths of the base cylinders and the axis of ordinate represents a helix advancing amount, wherein the male screw rotor 5 comprises an equal lead screw 5*a*1, an unequal lead screw 5*b*1, and an equal lead screw 5*c*1 from the suction side and the female screw rotor 4 comprises an equal lead screw 4*a*1, an unequal lead screw 4*b*1, and an equal lead screw 4*c*1 from the suction side.

Next, FIG. 4 is a perpendicular-to-axis sectional view of the male and female screws. As shown in FIG. 4, the number of teeth of the male screw rotor 5 is smaller than that of the female screw rotor 4. On the other hand, a male screw outer diameter 19 is larger than a female screw outer diameter 20. By providing the engagement between male screw teeth 21 and female screw teeth 22 outside the gear engagement pitch circle 15 of the male screw rotor 5 and the gear engagement pitch circle 16 of the female screw rotor 4 according to the foregoing conditions, the tooth-surface speeds of the male and female screws differ from each other so that the tooth surfaces of the male screw teeth 21 slide on the tooth surfaces of the female screw teeth 22 to rake out the product or the like existing between the tooth surfaces of the male and female screw teeth.

Figure 5:
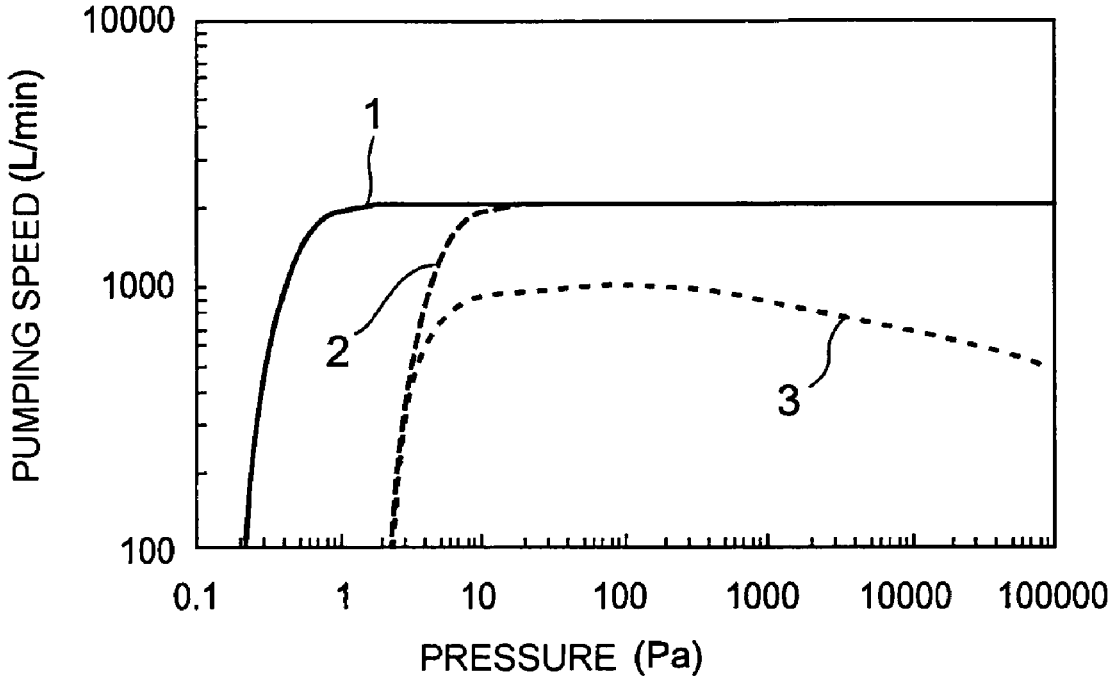
FIG. 5 is a diagram showing a comparison in pumping speed between the pump according to this invention and a conventional pump.

As described above, in the embodiment of this invention, the pumping speed of the screw vacuum pump is largely improved as indicated by a curve 1 in FIG. 5 so that the stable pumping speed can be achieved efficiently from the atmospheric pressure to 0.1 Pa by the use of only one vacuum pump, thereby covering the wide operation range. Further, the effect has been achieved that rakes out the reaction product.

As described above, according to this invention, the effect can be achieved that the pumping speed of the screw vacuum pump is largely improved so that the stable pumping speed can be obtained efficiently from the atmospheric pressure to 0.1 Pa by the use of only one vacuum pump, thereby covering the wide operation range. Further, in this invention, the effect can be achieved that rakes out the reaction product.

Further, by the use of the vacuum pump of this invention, an effect can be achieved that it is possible to constitute a vacuum system that is simple in structure and low in price as compared with a vacuum system in the combination of the conventional dry pump, mechanical pump, and so on.

Moreover, according to this invention, since the structure of the vacuum system becomes simple, an effect can be achieved that complicated operations such as switching of valves become unnecessary to thereby enable a control system to be simple and low-priced.

INDUSTRIAL APPLICABILITY

As described above, the screw vacuum pump according to this invention is suitable as a vacuum pump for use in a system of manufacturing semiconductor devices and so on.

The invention claimed is:

1. A screw vacuum pump comprising a pair of male and female unequal lead screw rotors, wherein said male and female unequal lead screw rotors include equal lead portions having a lead angle equal to an inlet-side lead angle and formed on an inlet side thereof; equal lead portions having a lead angle equal to a discharge-end lead angle and formed on a discharge side thereof; unequal portions having a lead angle continuously decreasing from the inlet-side lead angle to the discharge-end lead angle and formed between the equal lead portions formed on the inlet side and the equal lead portions formed on the discharge side; and engagement between the male and female lead screw rotors is formed at a position different from each of gear engagement pitch circles, said circles being determined by a distance between axes of said male and female rotors and the numbers of teeth of engagement gears of said male and female rotors, each of said unequal lead portions having a length longer than that of each of said equal lead portions along an axis of said pair of male and female rotors.

2. A screw vacuum pump comprising a male rotor and a female rotor respectively having engagement screw gears, a stator receiving therein both rotors; a gas working chamber formed by the male rotor and the female rotor and the stator; and an inlet port and a discharge port for a gas provided at said stator configured to communicate with one end portion and the other end portion of said working chamber, respectively, wherein each of said male and female rotors includes a main lead screw at its middle portion in which a helix angle of said screw gear continuously changes following the advance of helix, a sub lead screw in the form of an equal lead screw formed on a discharge side of said male and female rotors, and an additional lead screw in the form of an equal lead screw provided on an inlet side of said male and female rotors, said main lead screw having a length longer than that of each of said sub lead screw and said additional lead screw along an axis of each of said male and female rotors.

3. The screw vacuum pump according to claim 2, wherein the sub lead screw is in the form of the equal lead screw formed in the range of 1 to 4 leads at a lead angle of said main lead screw.

4. The screw vacuum pump according to claim 2, wherein said additional lead screw is in the form of the equal lead screw formed in the range of 0.2 to 1 lead at a lead angle of said main lead screw.

5. The screw vacuum pump according to any one of claims 2 to 4, wherein engagement of said screw gears of said male and female rotors is located at a portion different from each of gear engagement pitch circles determined by a distance between axes of said male and female rotors and the numbers of teeth of said male and female rotors.

6. The screw vacuum pump according to any one of claims 2 to 4, wherein each of said screw gears of said male and female rotors have mutually different numbers of teeth.

7. The screw vacuum pump according to claim 1, wherein said inlet-side lead angle is 45 degrees.

8. The screw vacuum pump according to claim 2, wherein said additional lead screw has a lead angle of 45 degrees.

* * * * *